US006165059A

United States Patent [19]

Park

[11] Patent Number: 6,165,059

[45] **Date of Patent: *Dec. 26, 2000**

[54] ABRASIVE MEDIUM WITH SELECTED DENSITY

[76] Inventor: Joon Park, 1320 Virginia Ave., Glendale, Calif. 91202

[ * ] Notice: This patent is subject to a terminal disclaimer.

[21] Appl. No.: 09/044,213

[22] Filed: Feb. 19, 1998

Related U.S. Application Data

[63] Continuation-in-part of application No. 08/723,312, Sep. 30, 1996, Pat. No. 5,730,645, which is a continuation-in-part of application No. 08/999,571, Dec. 19, 1997, abandoned

[60] Provisional application No. 60/007,531, Nov. 24, 1995, and provisional application No. 60/023,478, Aug. 6, 1996.

[51] Int. Cl.[7] ..... B24B 31/06

[52] U.S. Cl. ..... 451/330; 451/326

[58] Field of Search ..... 451/32, 35, 326, 451/330

[56] References Cited

U.S. PATENT DOCUMENTS

| | | | |
|---|---|---|---|
| 1,431,475 | 10/1922 | Macdonald | 451/330 |
| 1,890,443 | 12/1932 | Anstice et al. | 451/330 |
| 2,431,870 | 12/1947 | Huenerfauth et al. | 451/330 |
| 2,978,850 | 4/1961 | Gleszer | 451/330 |
| 3,808,747 | 5/1974 | Kenagy | 451/330 |
| 4,736,547 | 4/1988 | Bond et al. | 451/330 |
| 5,015,299 | 5/1991 | Schweder | 451/330 |
| 5,730,645 | 3/1998 | Park | 451/32 |

FOREIGN PATENT DOCUMENTS

| | | | |
|---|---|---|---|
| 57-178662 | 11/1982 | Japan | 451/330 |
| 1517093 | 7/1978 | United Kingdom | 451/330 |

*Primary Examiner*—Eileen P. Morgan
*Attorney, Agent, or Firm*—Allen A. Dicke, Jr.

[57] ABSTRACT

The hard coated abrasive medium is formed by providing a hollow body with abrasive deposit on the outer surface. The buoyancy is provided by the enclosed air space, and the weight is defined by the weight of the body plus the hard plating or the abrasive grit deposited thereon. The density is selected in accordance to the character of the workpiece with which it is to be used in order to optimize the abrading action by interacting with the workpiece in the optimum fashion. In one embodiment, the abrasive grit is bonded to the exterior surface of the abrasive medium in a spiral shape to accelerate the abrading action.

20 Claims, 1 Drawing Sheet

ABRASIVE MEDIUM WITH SELECTED DENSITY

CROSS-REFERENCE

This application relies upon provisional application Ser. No. 60/007,531, dated Nov. 24, 1995, on provisional application, Ser. No. 60/023,478, filed Aug. 6, 1996, which is a CIP of Ser. No. 08/723,312, filed Sep. 30, 1996 for "Hard Coated Abrasive Medium with Selected Density," now U.S. Pat. No. 5,730,645, granted Mar. 24, 1998, which is a continuation-in-part of utility patent application, Ser. No. 08/999,571, filed Dec. 19, 1997, for "Abrasive Medium with Selected Density for Wearing Processes" now abandoned, the entire disclosures of which are incorporated herein by this reference.

FIELD OF THE INVENTION

This invention is directed to an abrasive medium which can be manufactured with a density lower than 1 or manufactured with a density greater than 1, and is particularly useful in abrading processes where the density and abrasiveness of the medium can be selected according to workpiece and process characteristics.

BACKGROUND OF THE INVENTION

There has arisen in recent years processes for imparting a soft, worn look to new clothing, in particular denim jeans. This is related to the laundering industry and is a wet process known as "stone washing." Consumers will pay a significant premium for clothes have a soft, worn look. A number of methods have been developed for washing new garments and fabrics to cause them to have the desired feel and appearance. Among the methods presently employed for stone washing include washing with large pumice stones, usually ½ to 4 inches in diameter. These large stones circulate in a washing machine during the wash cycle and cause the garments to abrade and soften. It can be appreciated that this sometimes creates wear to the garments and makes them unsuitable for sale. Volcanic rock is usually more glassy than pumice and is sometimes used in a similar way. U.S. Pat. Nos. 4,575,887 and 4,750,227 represent this type of wet process.

Manufactured substitutes for the natural pumice and volcanic rock have been tried. U.S. Pat. No. 5,359,745 teaches a briquette formed of glass and calcium carbonate which is then fired to produce a foamed glass briquette which substitutes for the pumice stone. Synthetic polymer composition material has also been taught to be useful in creating a briquette. In U.S. Pat. No. 5,367,734, polyvinyl chloride is filled with abrasive aluminum trihydrate to provide a resilient, yet abrasive pellet. This structure is thought to be less likely to pound holes into the garment. Similarly, U.S. Pat. No. 5,093,948 teaches the use of an elastomer rubber ball made of polybutadiene without any abrasive. Many different materials and shapes have been used as the abrasive medium in stone washing of garments to achieve alterations in the surface and texture of the garment.

There are many different abrasive mediums that are commonly used in various processes, including wood, walnut shells, sawdust, granite, various metals, limestone, ceramic beads, dry ice, nylon, rubber and synthetic rubberized abrasive. These abrasive mediums are used in tumblers or barrels, wet or dry, depending upon the process involved. It is believed that all presently used abrasive medium is a consumable product because the surface of the medium changes its characteristics with wear, and the medium itself wears out through the abrading action on the workpieces. This limits the usage of many common mediums which are used in food product applications, such as skin-peeling processes for potatoes, nuts or carrots. In pedicure processes, dead skin (callous) is removed by abrading with a pumice stone. This process takes place in a water bath. Therefore, it is desirable to employ a pedicure abrasive medium which has a density less than 1 so that it floats on the water. Sterilization of pumice stone is difficult because it has deep cavities and porosity which are not present in the presently disclosed abrasive. The disclosed abrasive medium can be readily cleansed of unwanted bacteria and viruses.

There is need for an abrasive medium which is of long wear life and which is of preselected density so as to properly interact with the workpiece.

SUMMARY OF THE INVENTION

In order to aid in the understanding of this invention, it can be stated in essentially summary form that it is directed to an abrasive medium with selected density. In this case, the body of the medium is made up of a pair of cups which face each other and which are sealed together to enclose the hollow interior space. The cups are metallic or are molded of synthetic polymer composition material, and the abrasive medium is coated thereon by plasma coating, hard material plating, or by inclusion in a softer matrix.

It is, thus, a purpose and advantage of this invention to provide an abrasive medium which can be manufactured with a selected density so as to be of proper density with respect to the workpieces it is to abrade.

It is another purpose and advantage of this invention to provide a hollow abrasive medium made of a cup and a cover which may be metallic or synthetic polymer composition material.

It is a further purpose and advantage of this invention to provide an abrasive medium with a density of less than 1, which is particularly useful in the stone washing of garments in a wet process or by the abrasive medium floats on the surface.

It is a further purpose and advantage of this invention to provide a process which accelerates abrading action by generating the motion of the abrasive medium and causing rubbing through rotary motion instead of rolling of the abrasive medium from edge to edge on and between the workpieces by providing a spiral shape of the surface of the abrasive medium. Rubbing provides a better abrasive action than rolling of the medium.

Other purposes and advantages of this invention will become apparent from a study of the following portion of the specification, the claims and the attached drawings.

DESCRIPTION OF THE PREFERRED EMBODIMENTS

Figure 1:
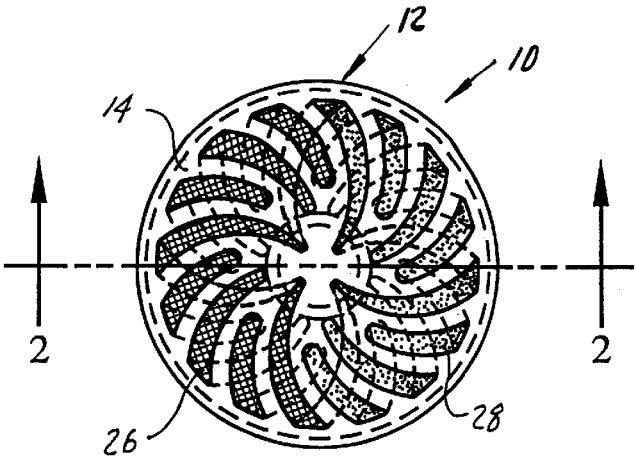
FIG. 1 is a plan view of the first preferred embodiment of the abrasive medium with selected density in accordance with this invention.
Figure 2:
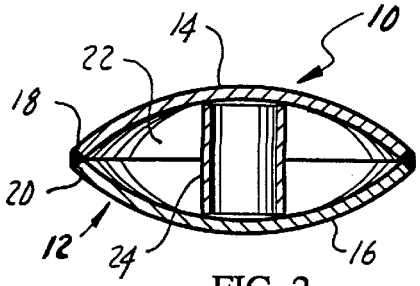
FIG. 2 is a section taken generally along the line 2—2 of FIG. 1.

The first preferred embodiment of the abrasive medium of this invention is generally indicated at 10 in FIGS. 1 and 2. The abrasive medium 10 has a body 12 which is formed of first and second cups 14 and 16. As is seen in FIG. 2, the rim 18 of first cup 14 fits against the rim 20 of second cup In final assembly, the rims are sealed together by any convenient means such as adhesive, reflow soldering, brazing, welding or the like. The exterior of the body 12 thus defines the volume of the abrasive member, and the interior space 22 defines its buoyancy. The weight is defined by the thickness of the material of the cups and by the abrasive applied. Thus, for the very lightest density, the thickness of the cup should be minimal. With minimal thickness, an interior support may be necessary to support the domes of the cups. Thus, support 24 is shown. The support 24 is tubular material and is installed before the cups are closed one on the other. The material of the cups is preferably thin ferrous material or may be a suitable synthetic polymer composition material, which can be coated and is sufficiently tough to provide adequate life in the abrasive environment.

The cups 14 and 16 are each convex outward when the rims are joined. The exterior surface is roughened to generate edges which will abrade workpieces against which the medium engages. Roughening 26 is in the form of a plurality of radially outwardly directed spirals on the exterior surfaces of both the cups 14 and 16. The surface may be roughened by coining, knurling, molding, indentation, scratching, or media blasting. The surface roughening may be all over the exterior surfaces, or it can be on the selected spiral areas which may or may not be defined as raised pads.

After roughening the exterior surface, a hard surface plating is applied. The hard surface plating is preferably hard chrome plating or a hard surface layer can be applied by physical vapor deposition. Such hard surface coatings are of such material as titanium nitrate, titanium carbonitride, chromium nitride or molybdenum disulfide. When the base metal is an aluminum alloy, the hard surface coating may be by hard anodizing.

Another way of generating an abrasive surface on the medium is to resin bond, mechanically bond or metallurgically bond abrasive grit 28 to the outer surface of the cups. The abrasive grit 28 may be applied on all of the exterior surfaces or applied to the selected spiral areas, which may or may not be defined as raised pads. The abrasive can be any hard material, such as diamond, silicon carbide, boron carbide, tungsten carbide, or cubic boron nitride. It can be deposited on the surface by any convenient deposition means, such as flame spraying, plasma arc spraying or deposition of the abrasive material in a softer matrix.

There are several ways to control the density of the abrasive medium 10. As a particular example, when the diameter D is 38 millimeters and the height H is 16 millimeters, the cups can be made out of 0.30 millimeter thick stainless steel. Since synthetic polymer composition materials have a lower density than ferrous materials, walls of greater thickness can be employed. When assembled with a 0.038 millimeter thick tungsten carbide coating, the net density is 0.9 gram per cubic centimeter. Thus, the density for a cup-shaped structure which can be conveniently manufactured ranges upward from 0.30. An increase of interior volume and decrease in the amount of material in the cups and coating can decrease the density down to 0.30 and still provide an abrasive medium with reasonable life.

Figure 4:
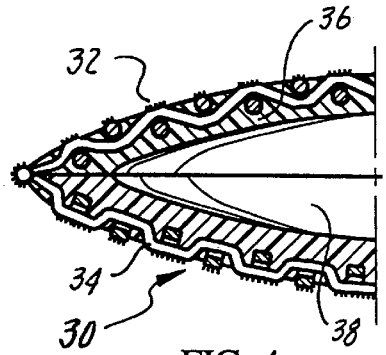
FIG. 4 is a view taken along the line 4—4 of FIG. 3.
Figure 3:
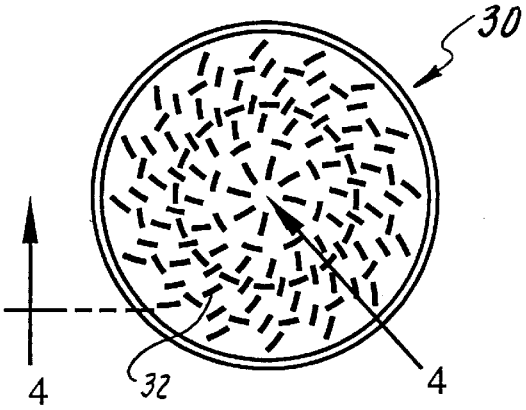
FIG. 3 is a plan view of a second preferred embodiment of an abrasive medium with selected density in accordance with this invention.

The abrasive medium 30, shown in FIGS. 3 and 4, is a second preferred embodiment of manufacturing an abrasive medium with selected density. The abrasive medium 30 is formed of first and second perforate metal cups 32 and 34. The perforate metal cups may be formed in any convenient way. Cup 32 is shown as being formed of woven metal strips or wire. Nickel or stainless steel are suitable materials and when they are woven into sheet form they are cut into round discs or other suitable shape. Another way of forming the cups is to start with perforated metal sheet. Such sheet is punched and formed to provide raised edges. The individual pieces are punched and are formed into shallow cups, as indicated as cup 34 in FIG. 4. While two different cup structures are shown it is expected that in any one abrasive medium, both cups would be formed in the same way. In this way, a combined metal/polymer abrasive medium is created, with the benefits of both materials.

The exposed metal surface of either cup structure is hard-surface plated or the abrasive grit is applied in the manner described. The same types of materials are used on the external surface in the manner described above. The perforate metal cups are attached to each other. After the attachment, a body of polymer material can be blow-molded into the cavity enclosed by the wire cups. The body of material 36 has a hollow interior 38 after the blow-molding. The size of this hollow interior controls the density. The body of material is a thermoplastic synthetic polymer composition material, which is resistant to the environment into which it will be placed.

There are a number of thermoplastic materials which are suitable for various washing purposes. For more heavy-duty and longer wearing purposes, polycarbonate thermosetting synthetic polymer composition material can be blow-molded into place and set.

Figure 6:
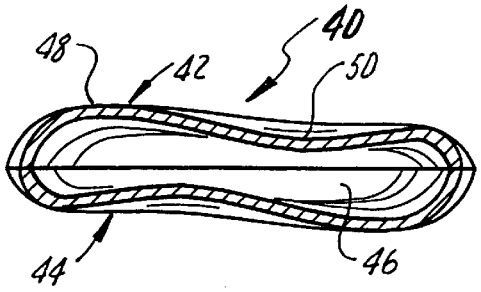
FIG. 6 is a view taken along the line 6—6 of FIG. 5.
Figure 5:
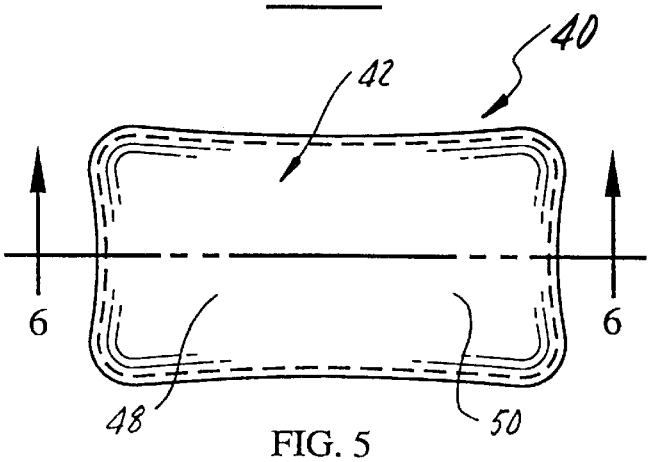
FIG. 5 is a plan view of a third preferred embodiment of an abrasive medium with selected density in accordance with this invention.

The abrasive medium 40, shown in FIGS. 5 and 6, is formed of two cups 42 and 44. The cups may be formed in the same manner and of the same materials as the cups 14 and 16, as shown in FIGS. 1 and 2, including stamping metal cups and injection molding synthetic polymer cups. This means that they are attached and sealed around the adjoining rims and define a hollow space 46 therein. Each of the cups has a convex section and a concave section. The convex section of cup 42 is shown at 48, while its concave portion is shown at 50. The external surfaces of the two cups are treated in the same way as the external surfaces of the medium 10, except that they are roughened and plated or covered with abrasive grit. The finished surfaces on the top and bottom can be of different roughness. In order to provide both a convex and a concave portion on the surface of each of the cups, the abrasive medium 40 is elongated. It may be generally rectangular, as indicated, or may have rounded ends in plan view. Furthermore, both of the cups can be designed to be of the same configuration at the edges so that identical cups can be used for each half of the medium. In the configuration indicated, the medium 40 is particularly useful in pedicure work.

Figure 7:
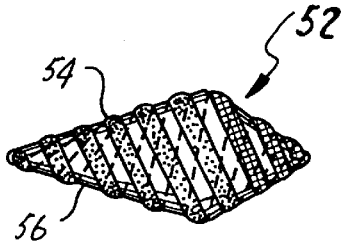
FIG. 7 is a plan view of a fourth preferred embodiment of the abrasive medium with in accordance with this invention.

FIG. 7 shows a fourth preferred embodiment of the abrasive medium where it is generally indicated at 52. The abrasive medium 52 is formed in the same way as the abrasive medium 10, but it is formed in a more conical fashion of two hollow cones secured together base-to-base. FIG. 7 shows that a spiral 54 is roughened and plated or an abrasive grit is bonded in the manner described with respect to the abrasive medium 10.

The spiral configuration of the abrasive surface 26 and 28 in FIG. 1, abrasive 32 in FIG. 3 and the abrasive 54 in FIG. 7, accelerates the abrasive action by generating rubbing on the surface through rotary motion instead of rolling of the abrasive medium from edge to edge on and between the workpieces, thus the spiral shape produces more abrasion, compared to a medium which has abrasive over the entire external surface. Abrasive material is friction material and, consequently, the abrasive medium will roll on a surface if it is not directed. This rolling decreases the efficiency of the abrasion. When the spiral configuration of the abrasive surface is presented to the material to be abraded, different portions of the conical spiral surface will have different relative velocities and, thus, will cause more abrasion than if the entire surface is covered with abrasive surface. This concept also works with the structure of FIGS. 3 and 4.

Cups made of synthetic polymer composition material can be thermoplastic or thermosetting plastic. They made by made as cup and cap and sealed together. The molding may be employed to produce the desirable rough surface. Abrasive coating may be accomplished by flashing, and then electro-plating on the hard chrome or other materials. When the surface is smooth, the roughness can be added in the plating by applying abrasive grit in the plating solution. When the surface is made rough in the mold or other post-molding procedure, it may be made of convective material or flashed and then plated with nickel.

Another way of providing an abrasive surface on a molded synthetic polymer medium would be to make the mold surfaces magnetic and coat them with a magnetic abrasive on the die surface. With the abrasive material held in placed by the magnetic force, injection of the polymer into the mold cavity would fill against the magnetically retained abrasive. When the synthetic polymer composition material is sufficiently hard, the magnetic force could be released from the dies to permit removal of the medium.

Another particular advantage of molding the abrasive medium of synthetic polymer composition material is that reinforcing ribs can be integrally molded onto the interior thereof to provide greater strength.

A particular process which utilizes an abrasive medium with a density below 1.0 is the abrasive wear of garments in commercial laundering machines for the purpose of imparting the appearance of wear and softening the fabric. In accordance with this process, the garments to be softened are placed in a commercial washing machine together with sufficient water and washing materials. These washing materials may include a desizing agent, a detergent and/or an emulsifier. In addition, the abrasive medium in accordance with this invention is placed therein in sufficient quantity. The machine is then agitated for 15 to 60 minutes until the garments are processed to the extent desired. At the end of agitation, the abrasive mediums float and are withdrawn from the top of the water. Another short cycle of agitation may be employed if it is necessary to release pieces of abrasive medium which are caught in the garments. After the abrasive medium is withdrawn from the surface, then the water and garments are separated. As is usual, further processing such as bleaching, neutralizing and rinsing may be employed, as required. The abrasive medium of FIG. 5 can be employed in the same way, but is particularly useful for personal types of usage such as pedicure use with water. It may also be used for abrading toenails and finger-nails.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An abrasive medium comprising:

a body, said body being formed with an external surface, at least a portion of said external surface being of rough surface configuration so as to be abrasive, said body being formed of at least one convex cup and a cover to define a hollow interior sealed space; and a hard surface material layer on at least the rough surface configuration of said external surface of said body, said hard surface material layer being sufficiently thin so as to not significantly reduce the roughness of said rough surface configuration.

2. The abrasive medium of claim 1 wherein said hard surface material layer is bonded to said body by metallurgical inter-dissolved structure, mechanical attachment or synthetic adhesive structure.

3. The abrasive medium of claim 2 wherein said rough surface configuration is formed of abrasive grit which is selected from the group including diamond, silicon carbide, boron carbide, tungsten carbide and cubic boron carbide.

4. The abrasive medium of claim 1 wherein said body is made of material selected from the group including synthetic polymer composition material and ferrous material.

5. The abrasive medium of claim 1 wherein said cup and cover have rims and said rims are attached to each other to define said hollow interior space and being sized so that the density of said abrasive medium is less than about 5.

6. The abrasive medium of claim 1 wherein said body has a spiral external surface portion on its exterior surface of said rough configuration and said hard surface is on said roughened surface.

7. The abrasive medium of claim 1 wherein said hard surface material is hard-plated material.

8. The abrasive medium of claim 7 wherein said hard plated material is deposited on said external surface and is selected from a group including hard chromium, titanium nitride and hard anodizing.

9. The abrasive medium of claim 1 wherein said body is made of metallic material and is formed of at least one convex cup and cover to define a hollow interior sealed space and said abrasive grit bonded to the exterior surface is bonded thereto in spiral configuration.

10. An abrasive medium comprising:

a body, said body being formed of a first and a second cup, at least one of said cups having an external surface which is partially convex and partially concave, said first and second cups being attached to each other to define a hollow interior sealed space;

at least one of said external surfaces being treated to be abrasive.

11. The abrasive medium of claim 10 wherein said external surface of each of said cups has a different rough abrasive surface configuration.

12. The abrasive medium of claim 10 wherein each said first and second cups has a different abrasive grit bonded thereto on said convex/concave exterior surface and the abrasive grit on said first cup is of different abrading characteristics than said abrasive grit bonded to said second cup.

13. An abrasive medium comprising:

a body, formed of at least one convex cup and cover to define a hollow interior sealed space; and abrasive grit bonded to the exterior surface of said body, said abrasive grit bonded to the exterior surface being bonded thereto in spiral configuration.

14. An abrasive medium comprising:

a body, said body being formed of at least one convex cup and a cover, said convex cup and said cover each being formed of material having perforations to form perforate material, said cover being attached to said cup to form a hollow perforate body, synthetic polymer composition material engaging in and closing the openings in said perforate material to define a closed hollow interior sealed space, a portion of said perforate body extending out of said synthetic polymer material to form exposed surfaces, said exposed surfaces having hard abrasive surfaces.

15. The abrasive medium of claim 14 wherein said exposed surfaces are bonded with abrasive grit.

16. The abrasive medium of claim 15 wherein said material filling said perforated material is a thermoplastic synthetic polymer composition material.

17. The abrasive medium of claim 14 wherein said exposed surfaces are rough and have hard plating thereon.

18. The abrasive medium of claim 14 wherein said cup and said cover are formed of stamped metal.

19. The abrasive medium of claim 18 wherein there is abrasive bonded to said stamped metal.

20. The abrasive medium of claim 18 wherein said stamped metal is rough at said perforations and said stamped metal is hard plated so that said roughness serves to abrade.

* * * * *